US006925705B2

(12) United States Patent
Neckoula

(10) Patent No.: US 6,925,705 B2
(45) Date of Patent: Aug. 9, 2005

(54) CAGE MAKING APPARATUS

(75) Inventor: Kamal Neckoula, Leighton Buzzard (GB)

(73) Assignee: NGR Limited, Beds (GB)

( * ) Notice: Subject to any disclaimer, the term of this patent is extended or adjusted under 35 U.S.C. 154(b) by 0 days.

(21) Appl. No.: 10/444,523

(22) Filed: May 23, 2003

(65) Prior Publication Data

US 2004/0020033 A1 Feb. 5, 2004

(30) Foreign Application Priority Data

May 23, 2002 (GB) ..... 0211876

(51) Int. Cl.[7] ..... B23P 21/00; B23P 19/00

(52) U.S. Cl. ..... 29/703; 29/700; 29/789; 29/819

(58) Field of Search ..... 29/703, 700, 779, 29/819; 140/112, 92.1, 92.2

(56) References Cited

U.S. PATENT DOCUMENTS

| | | | |
|---|---|---|---|
| 3,209,793 | A | 10/1965 | Miura |
| 3,579,259 | A | 5/1971 | Kato |
| 3,837,372 | A | 9/1974 | Bernot |
| 4,658,867 | A | 4/1987 | Hasak |
| 5,665,254 | A | 9/1997 | Isono |

FOREIGN PATENT DOCUMENTS

| | | |
|---|---|---|
| EP | 0 841 110 A2 A3 | 5/1998 |
| GB | 0 894 798 | 4/1962 |
| JP | 07 144243 | 6/1995 |
| WO | WO 01/39908 | 6/2001 |
| WO | WO 02/070169 A1 | 9/2002 |

*Primary Examiner*—John C. Hong
(74) *Attorney, Agent, or Firm*—Law Office of Leo Zucker

(57) ABSTRACT

Apparatus for making a cage having a number of peripheral and elongate components, and a wrapping component. The apparatus includes an elongate support frame, a mechanism for rotating the cage; a mechanism for dispensing the wrapping component onto the cage; a first carrier mounted on the frame for holding at least one peripheral component; and a second carrier mounted on the frame for holding at least one peripheral component, including a mechanism for adjusting the position of the second carrier on the frame relative to the position of the first carrier.

31 Claims, 14 Drawing Sheets

CAGE MAKING APPARATUS

BACKGROUND OF THE INVENTION

1. Field of the Invention

This invention relates to cage making apparatus. In particular, it relates to apparatus for making elongate steel cages for reinforced concrete piles, foundations and so forth.

2. Discussion of the Known Art

Steel cages are most typically assembled from steel bands, formers and rings welded to longitudinal bars. Traditionally, assembly of such cages has been a manual fabrication operation. This is a laborious and time-consuming operation that requires extensive preparation, but is still in widespread use. This is in part because there is a requirement that cages be made on-site to a wide range of specifications and configurations, meaning that any system for making cages must be both flexible and transportable if it is to receive widespread acceptance.

There is, therefore, a demand for apparatus that can automate production of cages with a view to reducing time and labor required, while maintaining the flexibility and range of application of manual systems.

One such apparatus known in the art comprises a machine having a rotatable shaft running parallel to a longitudinal axis of the machine that is supported at each end by frames. Towards the ends of the shaft there are provided holding devices for engaging a skeleton cage. In use, the skeleton cage is made on the machine. The holding devices engage the skeleton cage and the shaft is rotated by a motor thereby causing the cage to rotate. Steel wire is wrapped onto the cage from a drum. When the cage has been completed it has to be removed from the machine in a direction parallel to the shaft, i.e., along the longitudinal axis of the machine, because of the configuration of the apparatus, leading to an excessively large apparatus and a need for additional supporting devices to support the weight of the cage. Removing the cage along the length of the machine is a particular problem when a limited space is available for operating the machine. Another limitation of this type or machine is that it can only produce cages having a circular cross-section.

An aim of the current invention is to provide an apparatus that mitigates at least some of the aforementioned problems, and in particular that provides a more compact and integrated cage making apparatus.

SUMMARY OF THE INVENTION

According to a first aspect of the present invention there is provided an apparatus for making a cage having a plurality of peripheral and elongate components, and a wrapping component, said apparatus including: an elongate support frame; means for rotating the cage; means for dispensing the wrapping component on to the cage; a first carrier means mounted on the frame for holding at least one peripheral component; and a second carrier means mounted on the frame for holding at least one peripheral component including means for adjusting its position on the frame relative to the position of the first carrier means.

An operator is thereby able to adjust the separation of the first and second carrier means. This is particularly useful when commencing a cage making operation and when removing a completed cage from the apparatus. For example, the distance between the first and second carrier means can be increased to an extent greater than the length of the elongate components, such that the completed cage can then be removed from the apparatus transversely, that is, in a direction substantially perpendicular to the elongate support frame. The invention also facilitates production of different sized cages, in particular cages having different lengths and different diameters.

Preferably the means for adjusting the position of the second carrier means includes a carriage that is arranged for movement along at least part of the support frame. Advantageously the first carrier means may include means for adjusting its position on the frame relative to the position of the second carrier means.

Advantageously the first carrier means includes a frame and a gripping device for engaging at least one peripheral component, wherein the gripping device is rotatably mounted in the frame. Preferably the means for rotating the cage is arranged to rotate the gripping device, and includes at least one of an electric motor and a hydraulic drive system, and a gear system. Advantageously the second carrier means includes a frame and a gripping device for engaging at least one peripheral component, wherein the gripping device is rotatably mounted in the frame. Preferably the means for rotating the cage is arranged to rotate the gripping device, and includes at least one of an electric motor and a hydraulic drive system, and a gear system.

Advantageously the gripping device of at least one of the first and second carrier means is arranged to grip an internal face of the peripheral component. Preferably the gripping device includes an array of support members that can be extended to engage the peripheral component and retracted to disengage the peripheral component. This arrangement can be used to grip peripheral components of different diameters to produce a range of cage sizes.

Advantageously the apparatus includes a feeder mechanism for feeding an elongate component such that the elongate component is positioned in contact with the peripheral components. Preferably the peripheral components have outer walls and the feeder mechanism is constructed and arranged to position the elongate component against the outer walls such that the peripheral components are substantially perpendicular to the elongate component. Preferably the feeder mechanism includes an arm mounted for rotational movement and a telescopic arm. The characteristics of the arms can be combined in a single arm that is rotatably mounted and telescopic.

Advantageously the feeder mechanism is positioned between the first and second carrier means.

Advantageously the apparatus includes at least one support device arranged to support at least a part of the weight of the cage. Preferably the support device is mounted on the elongate support frame and includes means for moving its position along the elongate support frame. It is also preferred that the height of the support device is adjustable.

Advantageously the means for dispensing the wrapping component onto the cage includes a mobile carriage arranged to follow a first guide device mounted on the elongate support frame. Preferably the mobile carriage includes a second guide device for guiding the wrapping component as it is dispensed on to the cage.

Advantageously the apparatus includes a control unit for controlling operation of the apparatus, wherein the control unit includes a user interface that can be used by an operator and is arranged for inputting values corresponding to at least one of the diameter of the cage, the rotational speed of the cage, the number of elongate components and the wrap pitch required.

Advantageously the peripheral component is a ring, and preferably has a circular, polygonal or other peripheral shape.

Advantageously the wrapping component is a wire.

The apparatus makes cages having a plurality of peripheral and elongate components, and a wrapping component. A typical operation includes the steps: rotatably mounting a first peripheral component on the first carrier means, rotatably mounting a second peripheral component on the second carrier means wherein the peripheral components are aligned substantially coaxially, feeding a first elongate component with the feeder mechanism to abut the peripheral components, attaching the first elongate component to the first and second peripheral components, rotating the components through a predetermined angle about the axis using the means for rotating the cage, feeding a second elongate component with the feeder mechanism to abut the peripheral components, attaching the second elongate component to the peripheral components, fixedly attaching a wrapping component onto at least one of the components and dispensing the wrapping component onto the cage in a helical arrangement with the means for dispensing the wrapping component.

In most practical cases a third peripheral component is rotatably mounted on the first carrier means and a fourth peripheral component is rotatably mounted on the second carrier means. The four peripheral components are aligned substantially coaxially. Typically, a plurality of additional peripheral components are attached to the first elongate component, uniformly distributed along its length, and substantially coaxially with the peripheral components mounted on the carrier means. Preferably between 4 and 36 elongate components are attached to the peripheral components and the elongate components are uniformly distributed around outer walls of the peripheral components.

An embodiment of the present invention will now be described, by way of example only, with reference to the accompanying drawing in which like references indicate equivalent features, wherein:

DETAILED DESCRIPTION OF THE INVENTION

Figure 1:
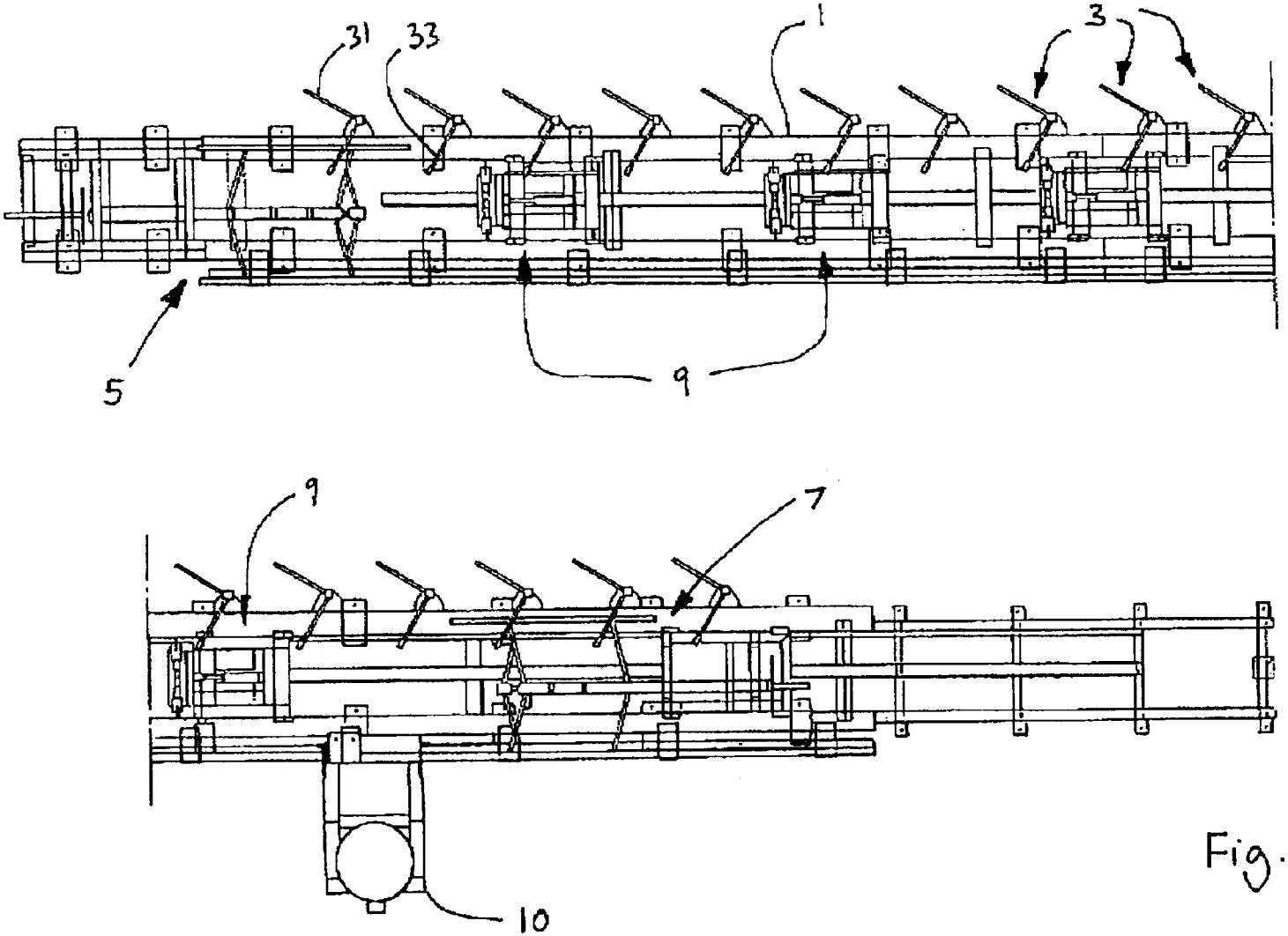
FIG. 1 is a split plan view of an embodiment of the current invention.
Figure 2A:
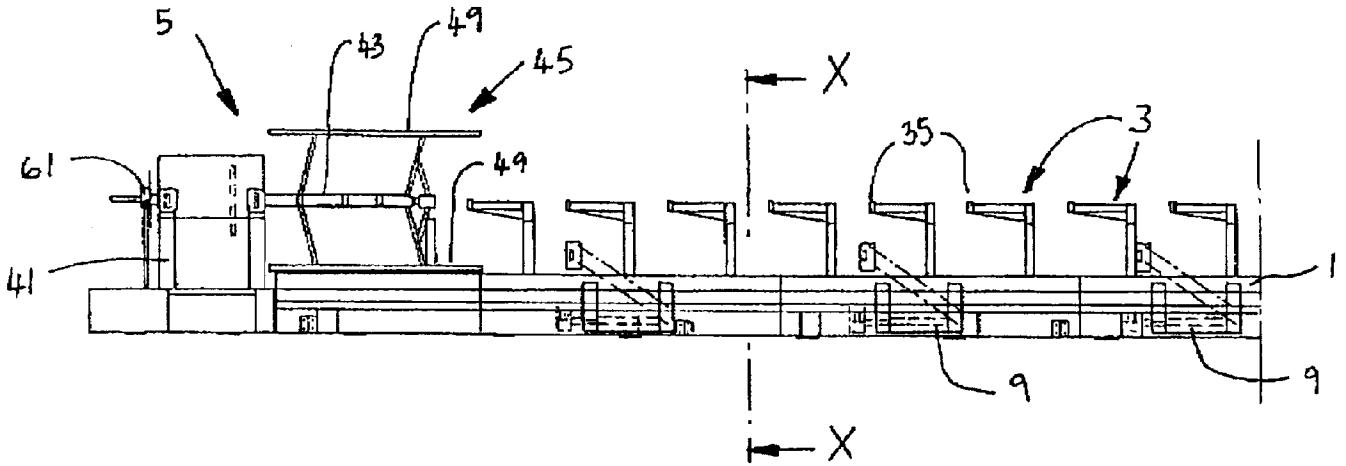
FIG. 2*a* is a split side view of the embodiment of FIG. 1.
Figure 2A:
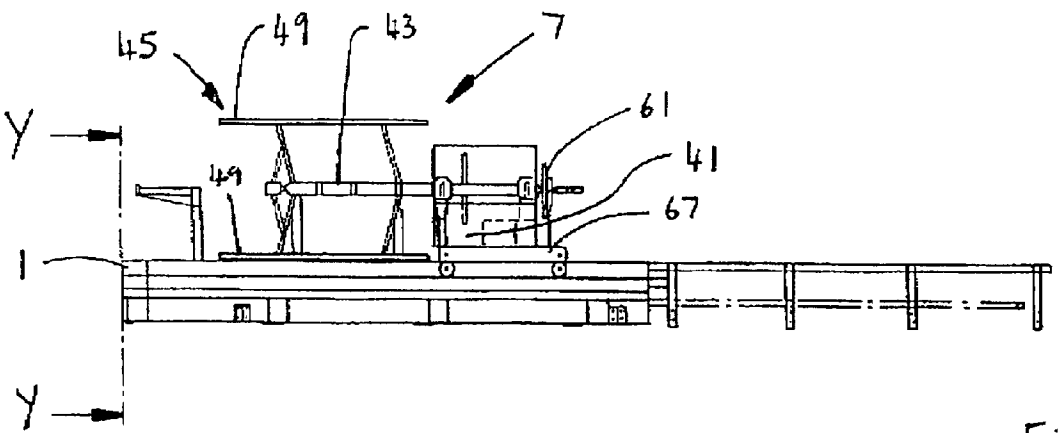

FIGS. 1 and 2*a* show the general arrangement of a cage making apparatus. The apparatus includes a beam section base (or chassis) 1, a set of bar feeders 3, a fixed spindle 5, a moving spindle 7, a set of cage guides 9, a microprocessor control unit (not shown) and a helixing trolley 10 (see FIG. 1).

Figure 2B:
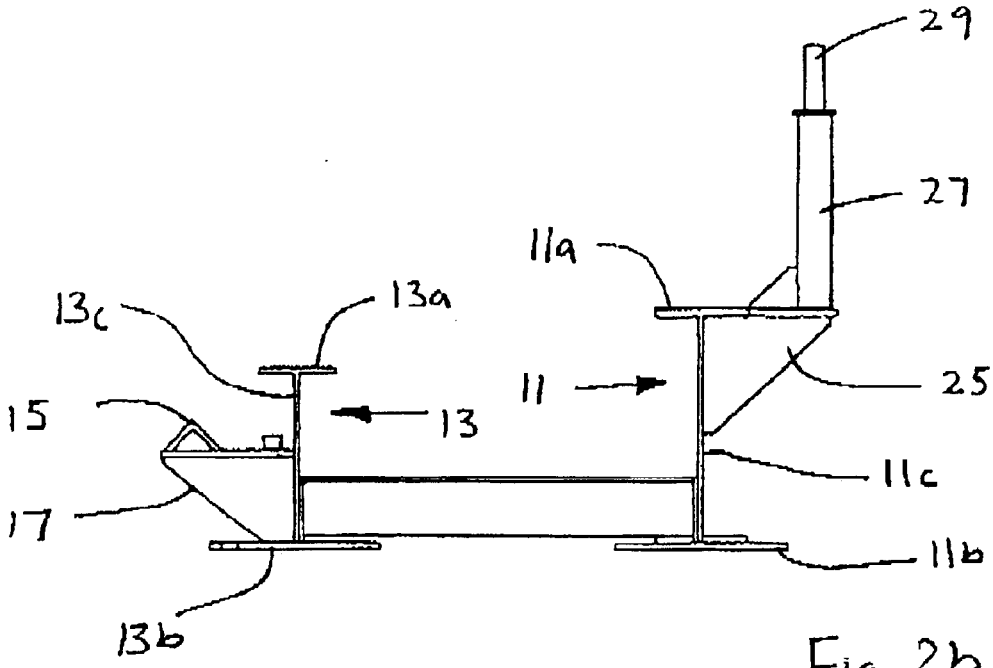
FIG. 2*b* is section X—X from FIG. 2*a;*

The beam section base 1 includes first and second steel beams 11, 13 of I-shaped cross-section that extend the length of the apparatus (see FIG. 2*b*), parallel to a longitudinal axis that will be referred to as "the machine axis". The beams are parallel and maintained spaced-apart by spacers. The beams are selected to confer the apparatus with a highly rigid construction, and additional cross-bracing between the beams is provided to this end. Each beam has an upper 11*a*,13*a* and lower 11*b*,13*b* flange, each being generally horizontal, and being interconnected by a vertical web 11*c*, 13*c*. The first steel beam 11 has a larger web height than the second steel beam 13.

Figure 2C:
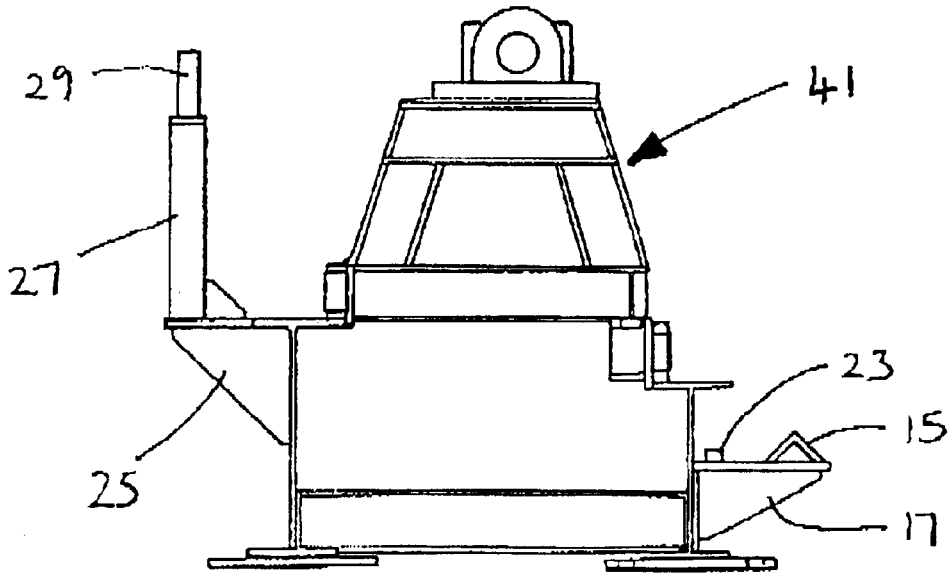
FIG. 2*c* is section Y—Y from FIG. 2*a;*

The base 1 also includes a guide 15 for the helixing trolley (see FIG. 2*c*). The helixing trolley guide 15 extends substantially the full length of the machine and is attached to the web 13*c* of the second steel beam by several bracket supports 17. The guide 15 includes a ridge extending along its length that is arranged to receive complementary guide wheels 19 attached to the helixing trolley 10. Preferably the guide 15 is made from angle iron and is welded to the brackets 17 to provide a rigid guide path. The base 1 also includes a channel 23 for electrical cables. The channel 23 protects the cables from mechanical damage.

Attached to the first beam 11 are sixteen bar feeders 3. The bar feeders 3 are distributed along the length of the first beam 11 and are attached to the beam by brackets 25. Each bar feeder 3 includes a support member 27; a support post 29, a first arm 31 and a second arm 33. The support member 27 is fixedly attached to the support brackets 25. The support post 29 is made from cylindrical steel tubing, and has a longitudinal axis that is substantially perpendicular to the machine axis. The support post 29 can rotate within the support member 27 about its longitudinal axis and is controllably rotated by a hydraulic system (not shown). This allows the bar feeders 3 to be rotated into a variety of operating positions depending upon the size and type of cage. The bar feeders 3 can also rotate into a non-operational position, for example when a cage is removed from the machine, or when there is a danger of the cage colliding with the feeders 3 during a cage making process. The height of the bar feeders 3 is also adjustable.

Attached towards one end of the support post 29 are first and second arms 31,33. The arms 31, 33 are angularly spaced by approximately 90 degrees. The first arm 31 includes an end stop 35. The second arm 33 includes a telescopic arrangement including first and second parts. The first part comprises a sleeve fixedly attached to the support post 29 and the second part is arranged for sliding movement within the sleeve. The position of the second part relative to the first part is determined by the diameter of the cage and is fixed using a grub screw. For: example, cages having smaller diameters require the second part to be extended a greater extent than cages having larger diameters.

The bar feeders 3 are arranged to receive longitudinal bars 37 that are used to construct a skeleton cage and to feed them substantially parallel to the machine axis. The longitudinal bars 37 are positioned on top of the first arms and are rolled across the second arms until they abut rings 39 used to form the cage. The longitudinal bars 37 are positioned substantially perpendicular to the rings 39 and are supported by the feeders 3 allowing an operator to weld each bar 37 to the circumference of the rings 39. Having the bar feeders 3 positioned between the spindles 5, 7 is particularly efficient since it minimizes the distance the bars 37 have to travel and is a factor in producing a compact apparatus.

Figure 3A:
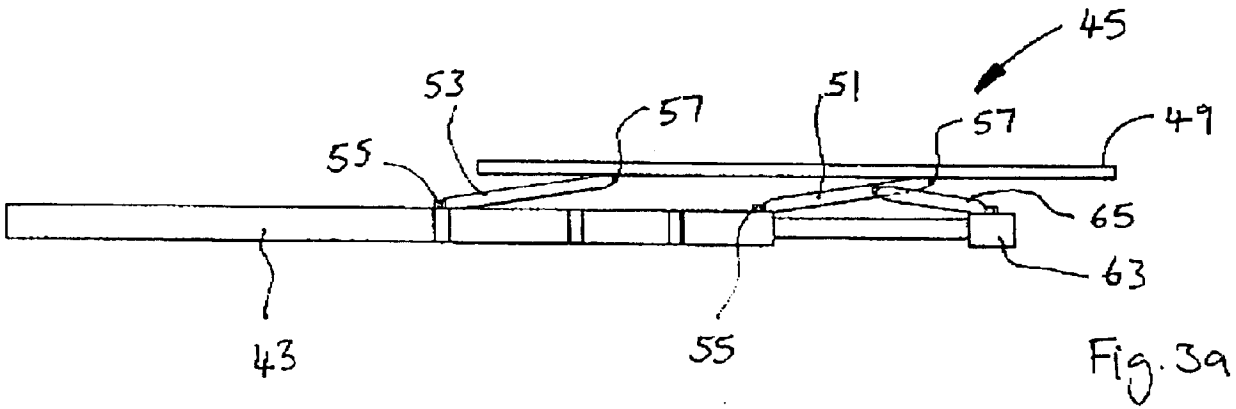
FIG. 3*a* is a side view of a ring support arrangement in a retracted position.
Figure 3C:
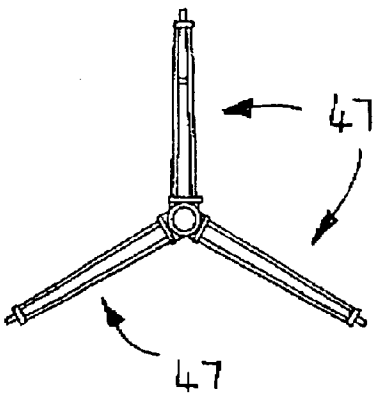
FIG. 3*c* is an end view of a ring support arrangement in an extended position.
Figure 3B:
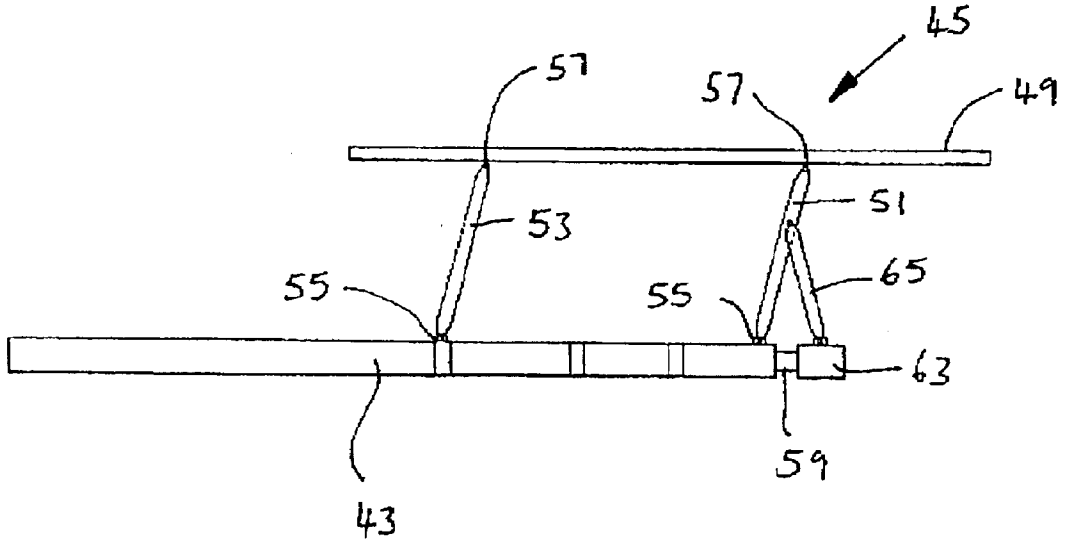
FIG. 3*b* is a side view of a ring support arrangement in an extended position.

Located towards one end of the apparatus is a fixed spindle 5. By "fixed spindle" it is meant that the spindle does not move longitudinally relative to the machine base 1. The fixed spindle 5 is used to support part of the weight of the cage, and to rotate the cage. The spindle includes a support structure 41 the position of which is fixed relative to the base 1, a sleeve 43 that is rotatably mounted on the support structure and that has a longitudinal axis arranged substantially parallel to the machine axis, a drive system for rotating the sleeve 43 and a ring support mechanism 45 (see FIGS. 3*a* to 3*c*).

The ring support mechanism 45 includes three support assemblies 47 angularly distributed about the circumference of the sleeve at 120 degree intervals. Each of the assemblies 47 includes an elongate ring support member 49 arranged substantially parallel to the sleeve 43 for engaging and tightly holding at least one ring 39 used to construct the skeleton cage, and first and second pairs of support arms 51, 53 linking the support member 49 to the sleeve 43. The first and second pairs of arms 51, 53 are attached to the sleeve 43 by first pivots 55, and to the support member 49 by second pivots 57, and are positioned in a spaced relationship to each other along the longitudinal axis of the sleeve 43.

The ring support mechanism 45 also includes a drive shaft 59 located within the sleeve 43 that is arranged for sliding movement therein and a mechanism 61 for moving the drive shaft 59 along the sleeve 43 and for fixing its position relative to the sleeve 43. Attached to one end of the drive shaft is a collar 63. Pivotally attached to the collar are three drive arms 65. Each drive arm is pivotally attached to one of the support assemblies 47.

The position of the support assemblies 47 can be controllably adjusted by moving the drive shaft 59 within the sleeve 43. Moving the drive shaft 59 towards the support structure 41 causes the drive arms 65 to push the support assemblies 47 into an extended configuration with the support members 49 moving radially outwards to increase their effective diameter and, in use, to engage the support members 49 with a ring 39. Moving the drive shaft 59 in the opposite direction causes the drive arms 65 to pull the support assemblies 47 into a retracted configuration with the support members 49 moving radially inwards to decrease their effective diameter and, in use, to disengage the support members 49 from the ring 39. The ring support members 49 move radially inwards and outwards such that they remain substantially parallel to the sleeve 43.

Figure 4A:
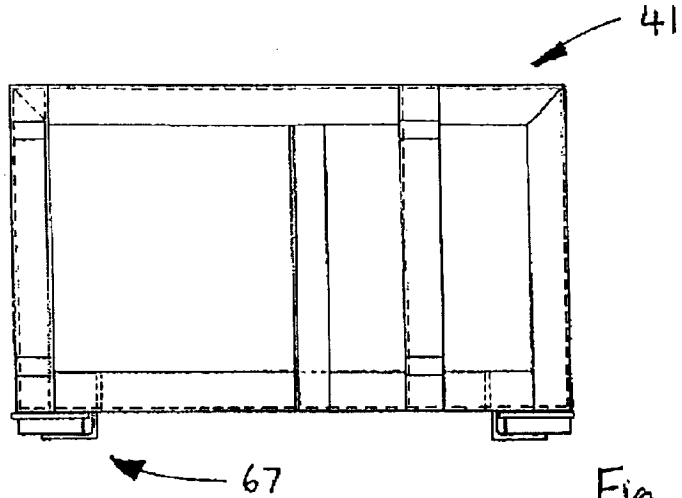
FIG. 4*a* is a plan view of a movable spindle support structure.
Figure 4B:
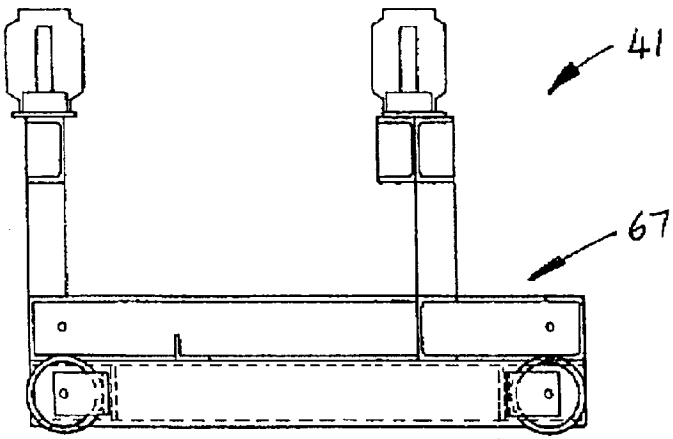
FIG. 4*b* is a side view of a movable spindle support structure.
Figure 4C:
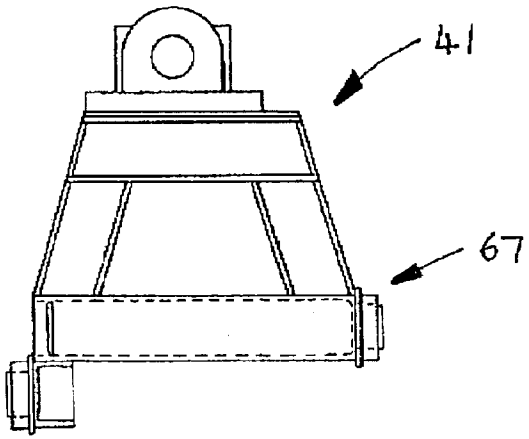
FIG. 4*c* is an end view of a movable spindle support structure.

Located towards the opposite end of the apparatus is a movable spindle 7. The fixed and movable spindles 5, 7 are arranged within the apparatus to face each other and are aligned along the machine axis. The movable spindle 7 is similar to the fixed spindle 5, however it is mounted on a carriage 67 that can move along the base 1 of the apparatus (see FIGS. 4*a* to 4*c*). The position of the spindle 7 along the base can be adjusted to suit the length of the cage. The spindle can then be fixed in position using a suitable clamping arrangement.

The cage, or a partially formed cage, is rotated by rotatably driving the sleeves 43 of the fixed and moving spindles 5, 7 via the drive systems which typically include electric motors and gearing arrangements. The motors are controlled by the microprocessor control unit which ensures that both spindles 5, 7 rotate at the same speed.

Figure 5B:
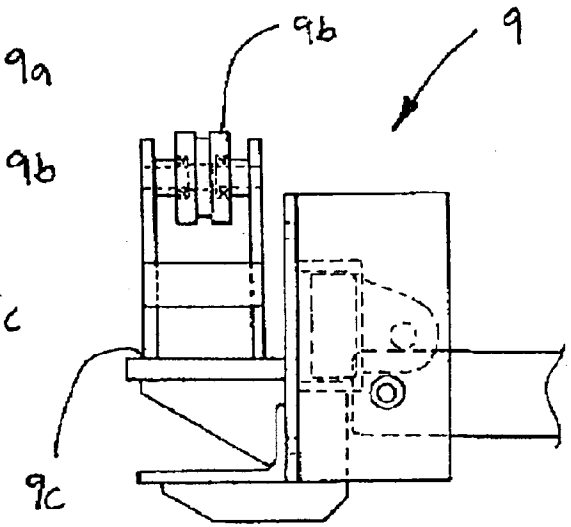
FIG. 5*b* is an end view of a cage guide head.
Figure 5A:
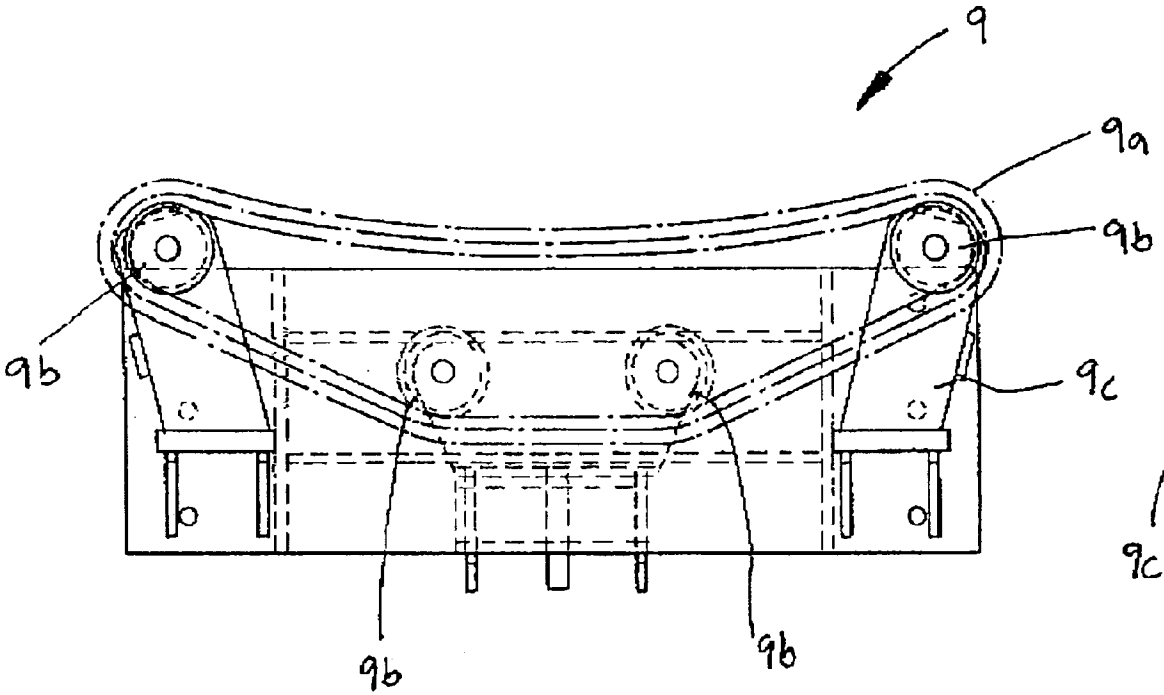
FIG. 5*a* is a side view of a cage guide head.

The apparatus also includes five cage guides 9 (see FIGS. 5*a* and 5*b*). The cage guides 9 are used to support some or all of the weight of the cage. During operation of the apparatus, the spindles 5, 7 support a small portion of the weight with most of the weight being supported by the cage guides 9 to prevent bowing along the length of the cage. When the cage has been fully formed, the ring support members 49 are retracted so that the cage can be removed from the apparatus. At this time, the cage guides 9 fully support the weight of the cage.

The cage guides 9 are positioned in the base 1 of the apparatus between the first and second beams 11, 13. The guides 9 include carriages mounted on the beams 11, 13 such that they can be moved along the apparatus by a chain, and are preferably positioned equidistant between the spindles 5, 7. Three of the guides 9 are removable from the apparatus. The two guides 9 closest to the fixed spindle 5 cannot be removed. The number of guides 9 required during operation of the apparatus is dependent upon the length of the cage, the shorter the cage the fewer guides required.

The cage guides 9 each include duplex support chains 9*a* wrapped around four rotatable sprockets 9*b*, mounted in a frame 9*c*. In use, the support chains cradle the cage and support the load as required. As the cage rotates, friction between the cage and the chains 9*a* causes the chains 9*a* to move around the sprockets 9*b* allowing the cage to rotate about a fixed axis. Optionally, the support chains 9*a* can be rotatably driven around the sprockets 9*b* by an electric motor controlled by the microprocessor control unit. The speed of rotation of the chains 9*a* is matched to the speed of rotation of the cage. This arrangement allows the cage to be more easily rotated.

The height of the guides 9 is adjustable and is get to accommodate the diameter of the cage. Preferably the height of the guides 9 is set at 1.5 times the diameter of the longitudinal bars 37 below the position of the rings 39. The height is controlled using a hydraulic system. Retainer chains can also be used to limit the extent of vertical movement of the guides 9. The height of the guides 9 can also be adjusted using the hydraulics when the cage has been fully produced, and the full weight of the cage rests on the guides 9. This is particularly useful since the guides 9 can lower the cage to make removal from the apparatus easier. The hydraulic system is controlled by the microprocessor control unit.

Figure 6:
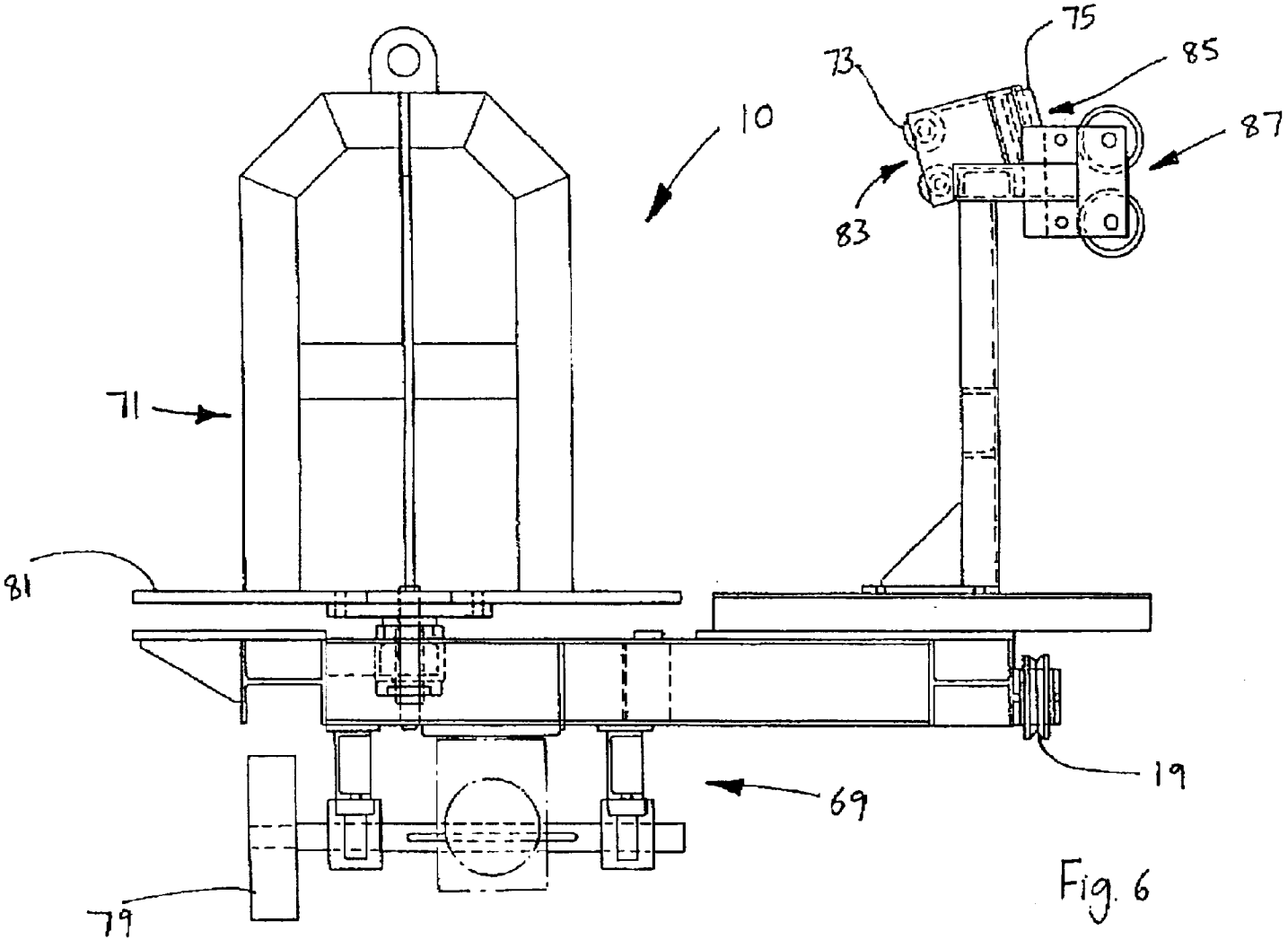
FIG. 6 is a side view of a helixing trolley.
Figure 7:
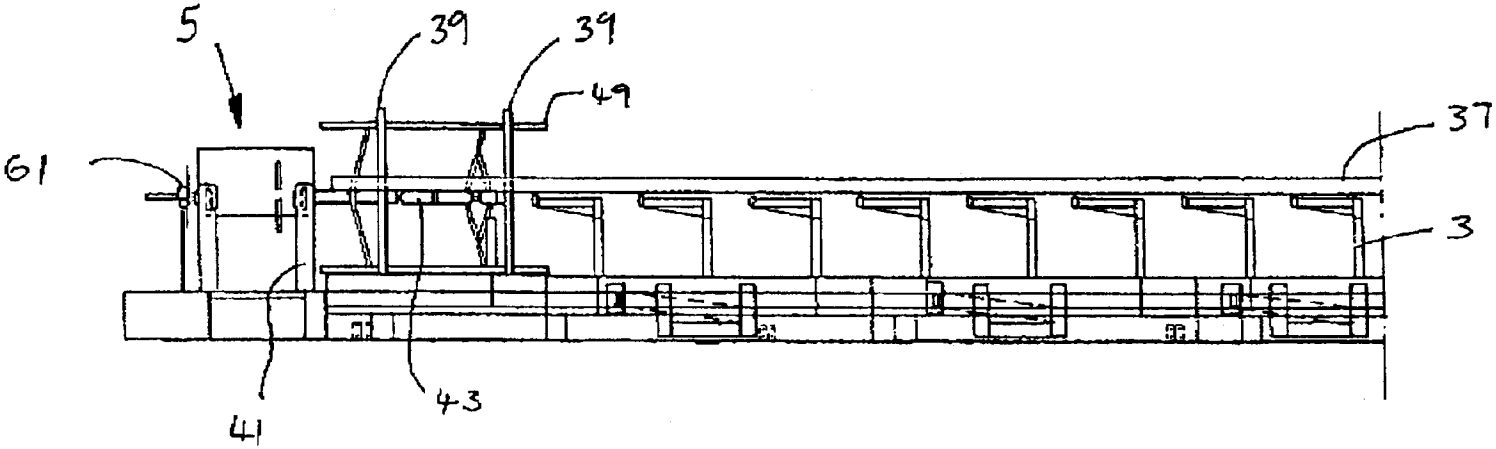
FIGS. 7 to 13 illustrate a cage making operation performed by an embodiment of the current invention.
Figure 7:
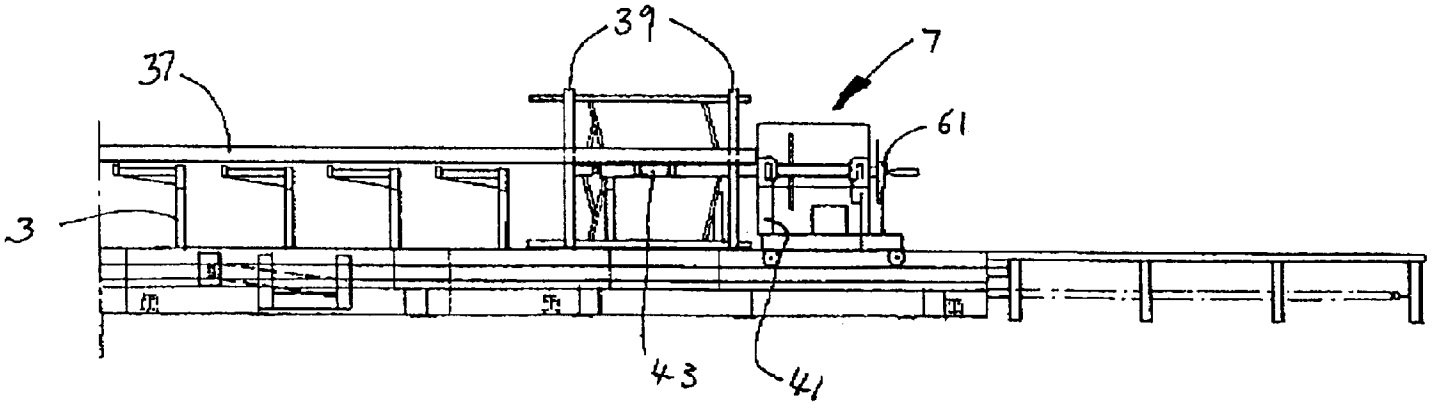
Figure 8:
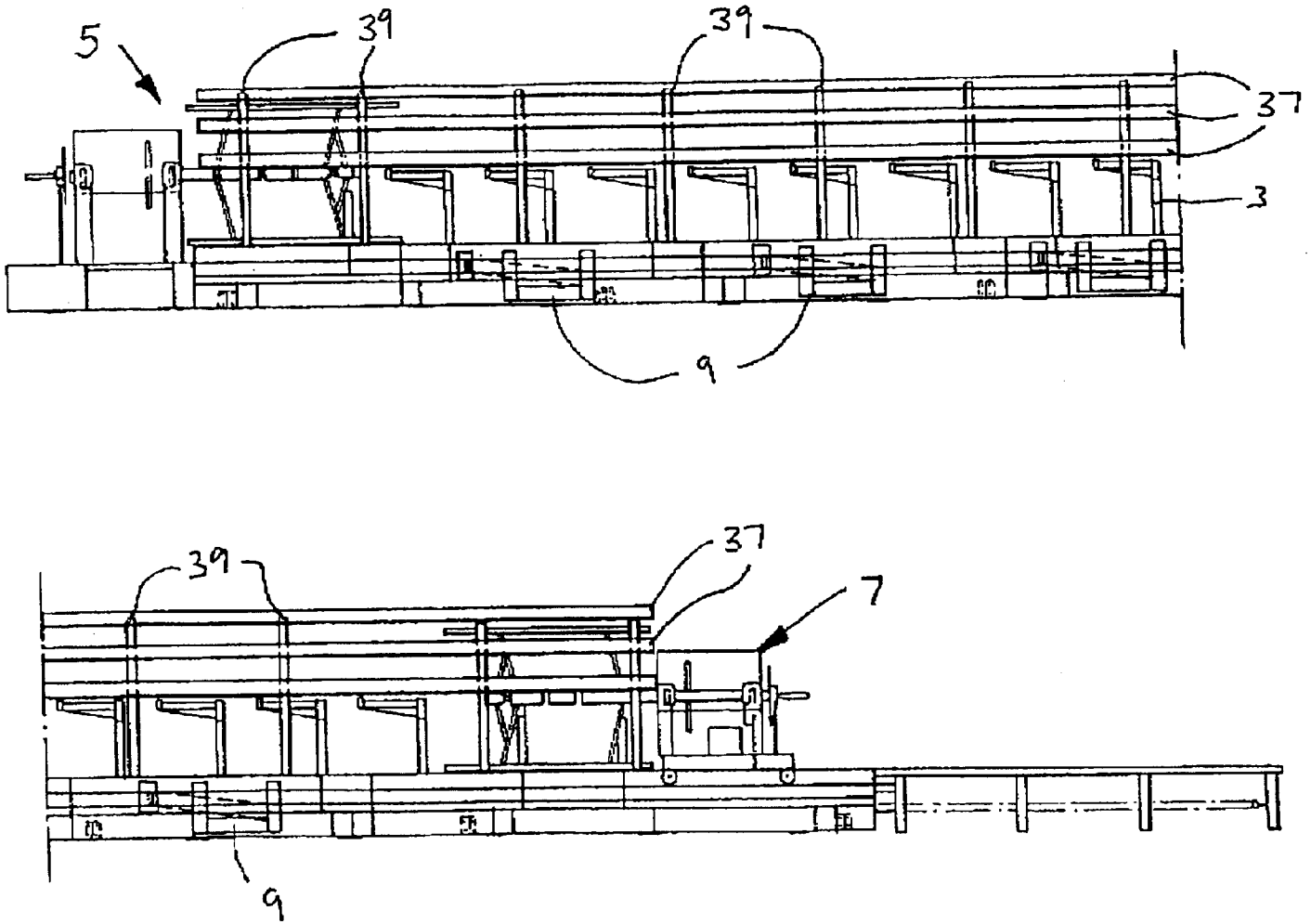
Figure 9:
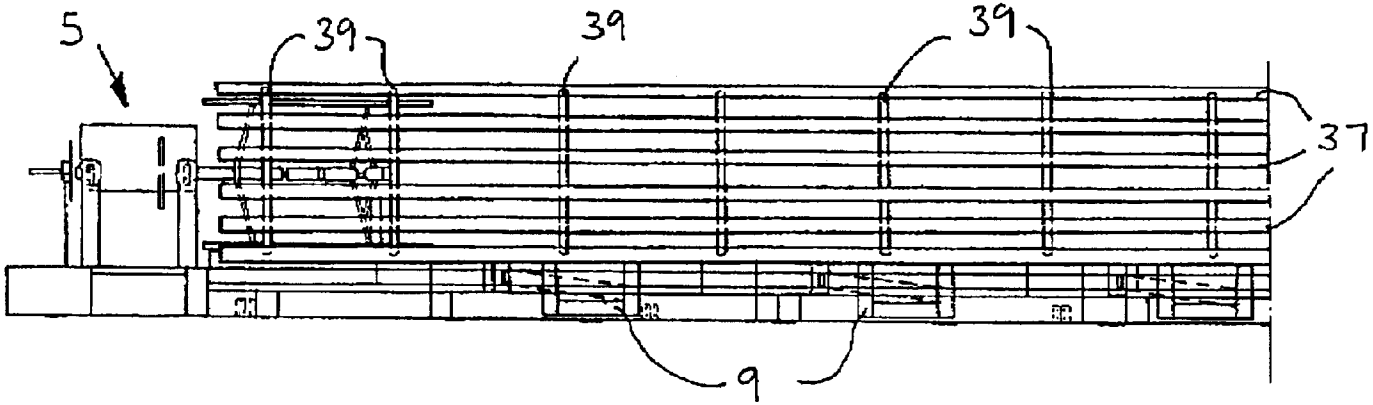
Figure 9:
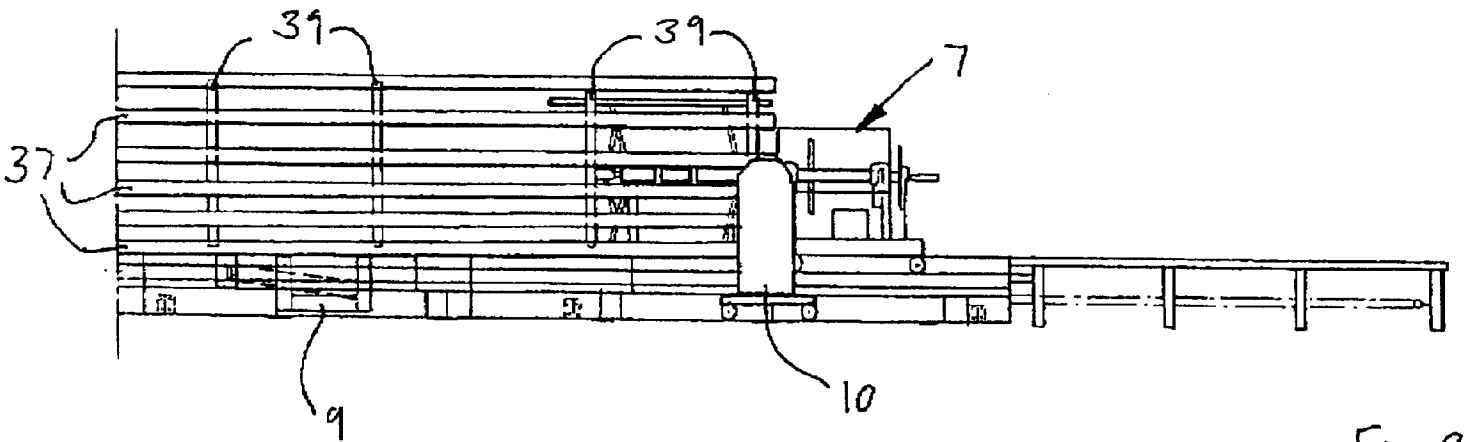
Figure 10:
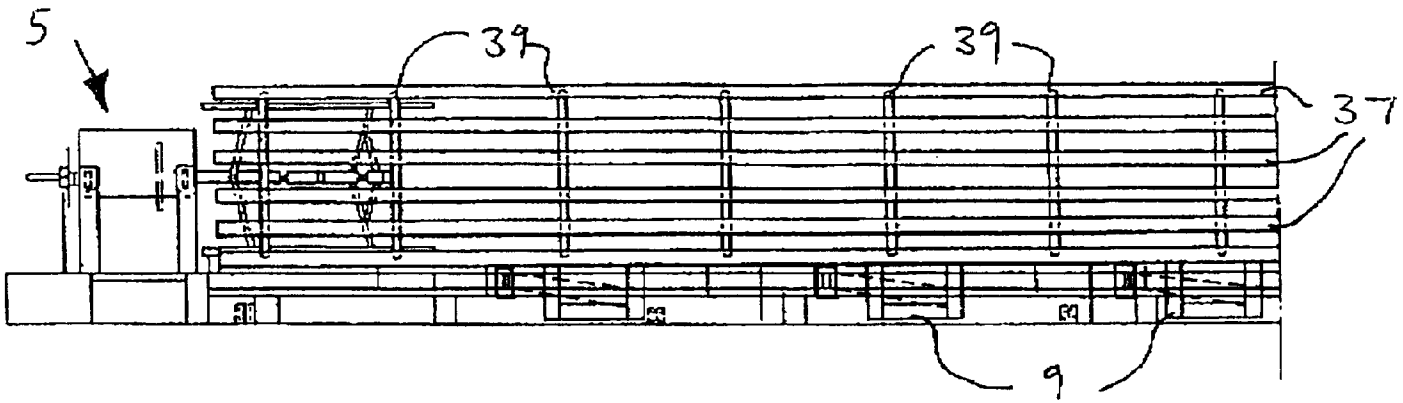
Figure 10:
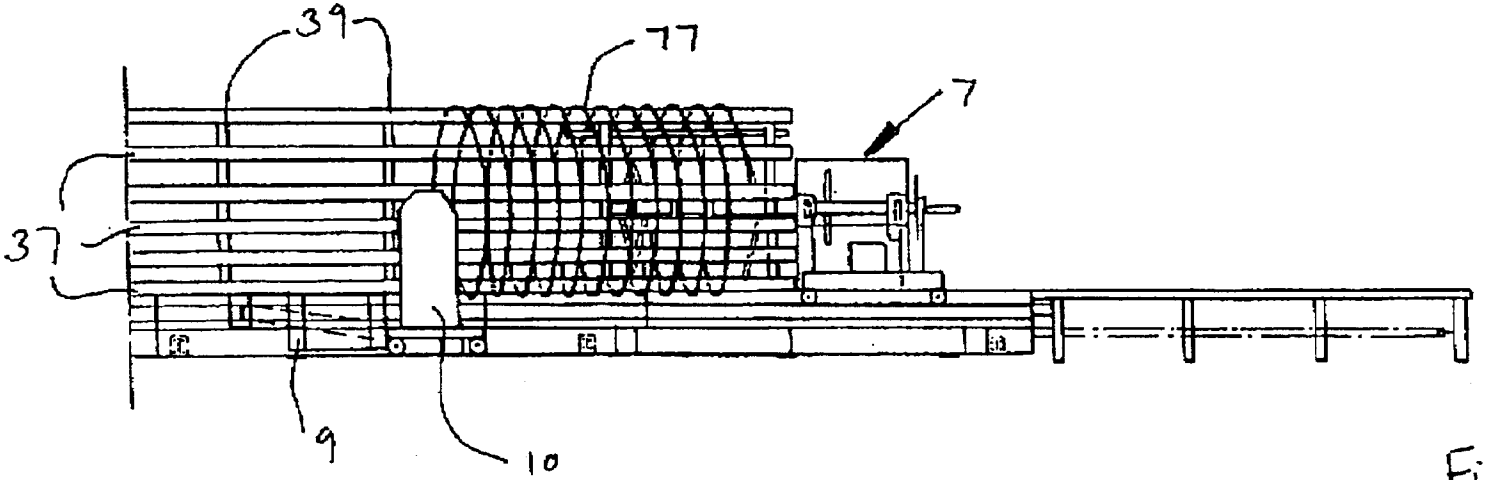
Figure 11:
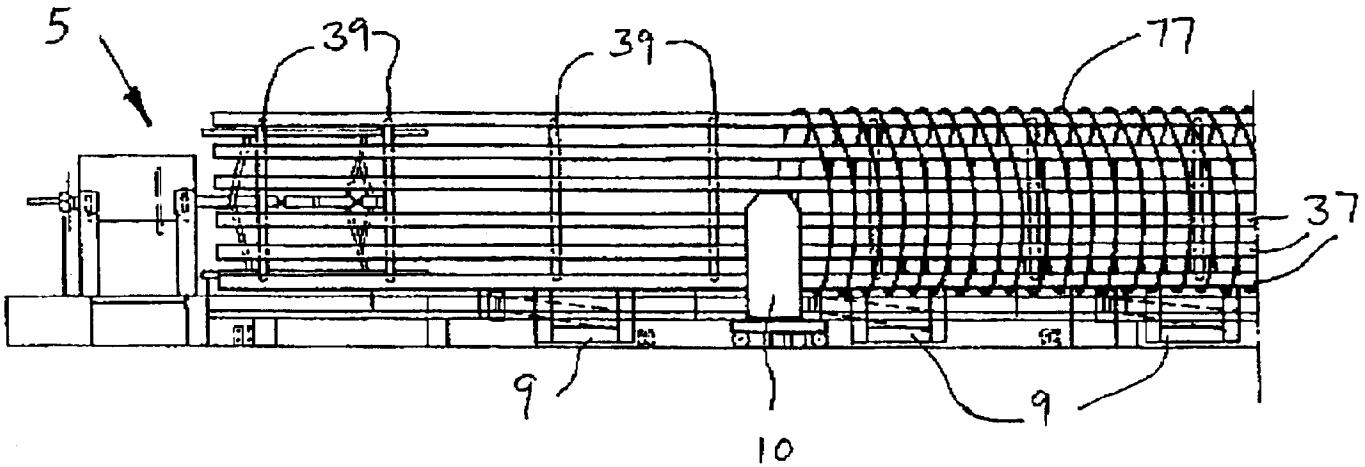
Figure 11:
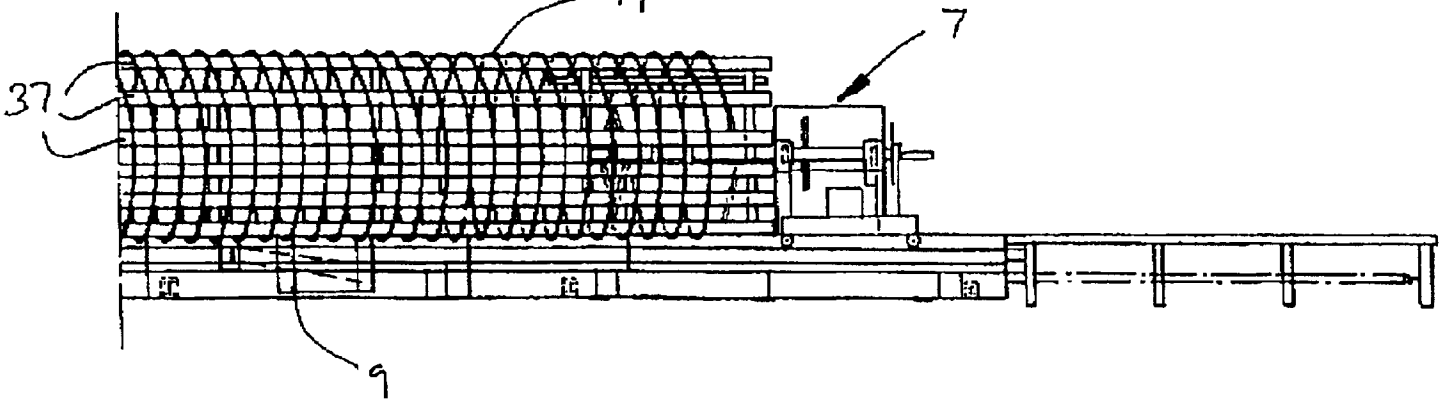
Figure 12:
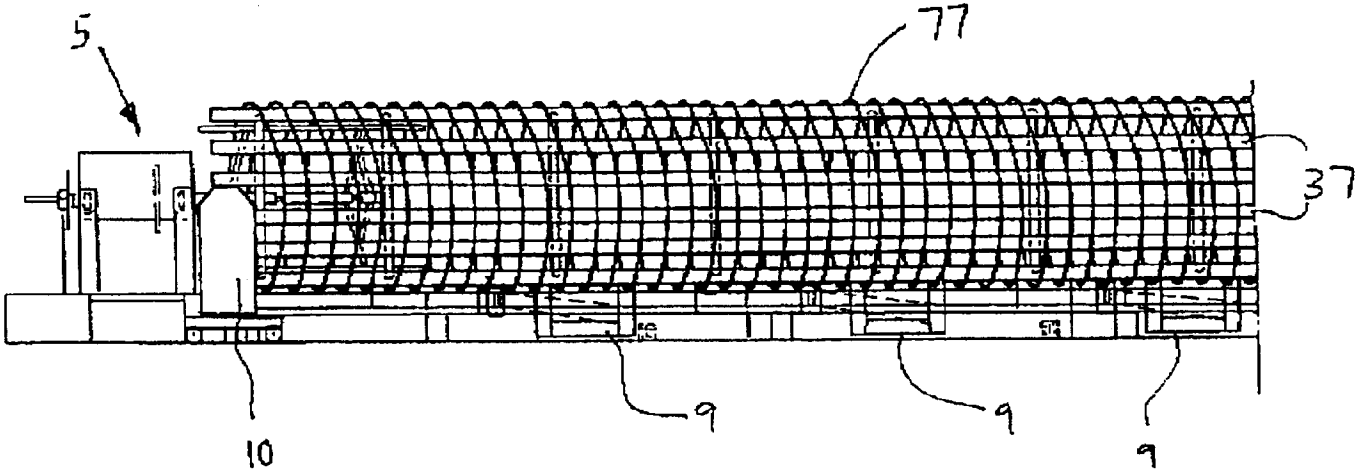
Figure 12:
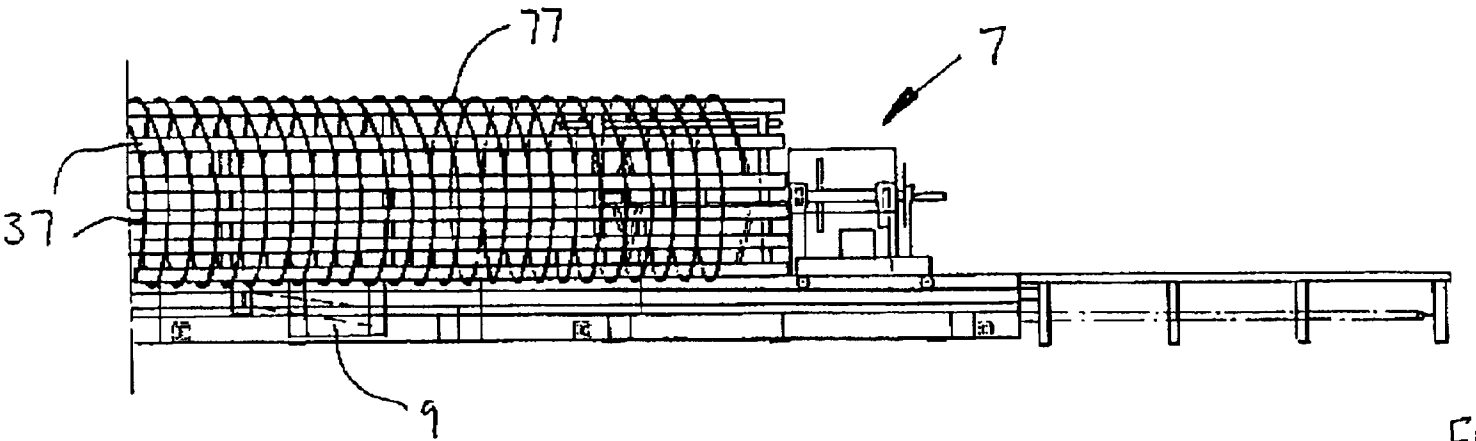
Figure 13:
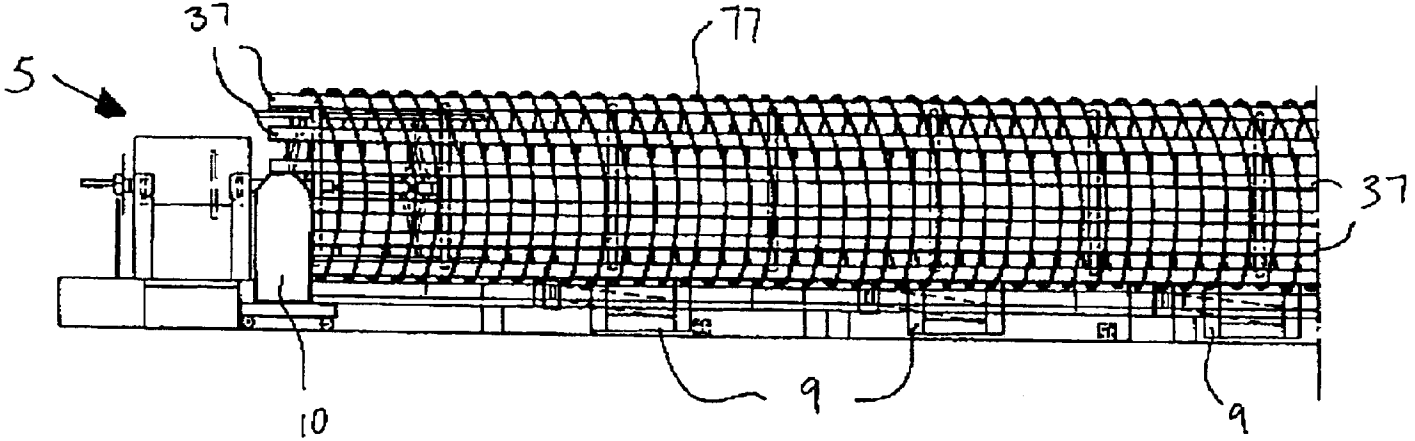
Figure 13:
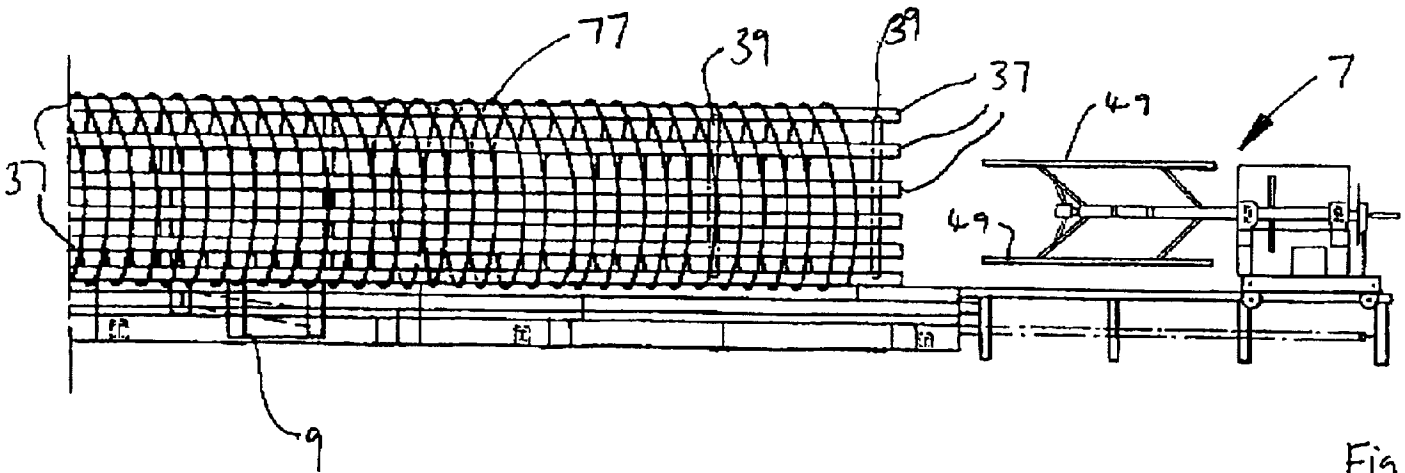

A side view of the helixing trolley 10 is shown in FIG. 6. The helixing trolley 10 includes a carriage assembly 69, an assembly for carrying reinforcing bar 71 and first and second pairs of rollers 73, 75. The reinforcing bar 77 is thick steel wire that is carried on the helixing trolley 10 in a coil about a drum. The carriage assembly 69 includes two sets of wheels 19, 79. The first set of wheels 79 engage the ground and are driven by an electric motor via a gearing arrangement. The second set of wheels 19 engage the helixing trolley guide 15 attached to the base 1. In use, these wheels 19 follow the guide which maintains the helixing trolley 10 at a predetermined distance from the base along its journey. The assembly for carrying reinforcing bar 69 supports the drum and includes a turntable 81 that rotates when the bar 77 is pulled from the drum and wrapped onto the cage. The rollers 73, 75 are arranged to guide the bar 77 as it is dispensed from the coil, ensuring that the bar 77 at all times follows a predetermined path extending transversely of the machine axis, and that the wire 77 is under controlled tension. The rollers 73, 75 are mounted in a frame with the first pair of rollers aligned substantially horizontally and the second set of rollers aligned approximately vertically. The curved surfaces of each pair of rollers 73, 75 form nips 83, 85 for receiving the reinforcing bar 77. In use, the reinforcing bar 77 is dispensed from the helixing trolley 10 by passing through the nips 83, 85 of both pairs of rollers. The trolley also includes a pair of guide rollers 87.

In use, one end of the reinforcing bar 77 is welded to one end of the skeleton cage. As the cage rotates the helixing trolley 10 is driven automatically, or manually, along the guide 15 parallel to the apparatus, dispensing reinforcing bar 77 which wraps helically around the longitudinal bars of the cage. The speed at which reinforcing bar 77 is dispensed is determined by the speed of rotation of the cage. The speed of rotation of the cage and the speed of the helixing trolley 10 are controlled by the microprocessor control unit and together they determine the pitch of the helical reinforcing bar 77 applied to the cage.

As a safety feature, limit switches are located towards the ends of the helixing trolley guide 15 which cut power to the drive motor of the trolley 10 to prevent the trolley 10 overrunning the guide 15 and colliding with other components of the apparatus.

The microprocessor control unit includes a user interface that allows an operator to control the apparatus. For example, the operator can control the speed of rotation of the spindles 5, 7 and hence the cage, the position and height of the cage guides 9 and the speed of the helixing trolley 10. The operator is able to enter data such as the diameter and length of the cage, the number of longitudinal bars 37, and the helix pitch. A typical range of values for speed of the spindles 5, 7 is between 7.5 and 15 revolutions per minute, 50 and 500 mm for the helix pitch, and 4 and 36 for the number of longitudinal bars 37. Advantageously, operation of the apparatus can be interrupted without adversely affecting the cage making process. Also, particular values may be altered, for example the speed of the spindles 5, 7 and speed of the trolley 10 can be increased during the process to adjust the pitch of the helical reinforcing bar 77. The microprocessor may include memory to store preferred settings.

A cage that can be constructed by apparatus in accordance with the invention includes a support ring 39, constructed of steel to have substantial strength. The support ring 39 forms a peripheral component of the cage, and at least one ring 39 is normally disposed close to one or both ends of the cage and also sometimes at one or more intermediate positions. A plurality of longitudinal bars 37 of the cage are attached to the outer circumference of the support ring 39 by welding, tying or otherwise. The longitudinal bars 37 are typically substantially straight, but may be profiled, for example to produce cages having a smaller diameter and tapered sides towards one end of the cage. The apparatus is also capable of producing cages including bars of shape code 41 (defined in British Standards relating to reinforcing bars) and rider bar cages. The cage is completed with wire 77 wrapped helically around the longitudinal bars 37. It should be noted that the support ring 39 need not have a circular cross-section. It may have one of a wide range of shapes, including circular, oval, triangular, square, rectangular or other polygonal. The spindles 5, 7 can be adapted to better suit gripping different shaped rings 39. For example, the spindles 5, 7 can include four ring support assemblies 47 angularly distributed around the circumference of the sleeve 43 at 90 degree intervals. This type of arrangement is better suited for gripping square or rectangular rings 39. Depending upon the relative lengths of the sides of rectangular rings 39 it may be necessary to increase, or decrease, the lengths of the support arms 51, 53 for two of the assemblies 47. Spindles 5, 7 having three ring support assemblies are particularly useful for gripping circular and triangular rings 39. Adjusting the angular position of the assemblies, and possibly the lengths of the support arms 51, 53, allows different types of triangular rings 39 to be gripped, for example isosceles and right angled triangle rings 39. This apparatus makes use of the ring 39 in the process of constructing the cage.

The operation of the apparatus will now be described with reference to FIGS. 7 to 13. The bar feeders in FIGS. 9 to 13 have been omitted for clarity.

First and second rings 39 are placed onto the ring support members 49 of the fixed spindle 5 such that the support members 49 pass through the rings 39. The rings 39 initially depend from the upper most support member 49 and are spaced apart. The fixed spindle mechanism 61 is operated to radially deploy the support members 49 to engage and tightly grip the rings 39. The rings 39 are then positioned substantially coaxially with each other and with the sleeve 43. Two additional rings 39 are placed on the moving spindle 7 in a similar manner.

A longitudinal bar 37 is placed onto the bar feeders 3 so that it is substantially parallel to the machine axis and abuts the rings 39 supported by the fixed spindle 5. The longitudinal position of the bar 37 is adjusted so that one end extends past the ring 39 closest to the support structure 41 by a short distance. The moving spindle 7 is then moved along the beams 1 such that the other end of the longitudinal bar 37 extends a short distance past both of the rings 39, and is locked in place. The height of the support guides 9 is then adjusted to suit the diameter of the cage and they are positioned equidistant between the spindles 5, 7.

An indexing process is then performed by the apparatus to ensure that the longitudinal bars 37 are correctly spaced around the circumference of the rings 39, for example spaced uniformly. The operator initiates the process using a user interface to the microprocessor control system and inputs values corresponding to the cage diameter and the number of longitudinal bars 37 required. The first bar 37 is then welded to the rings 39 gripped by the spindles 5, 7. Additional rings 39 are then welded to the longitudinal bar 37 at spaced intervals in between the spindles 5, 7 and are aligned substantially co-axially with the rings 39 supported by the spindles 5, 7. The operator then initiates an indexing program. The program calculates the angle through which the partially formed skeleton cage has to be rotated so that a second longitudinal bar 37 loaded onto the feeder 3 abuts the circumference of the rings 39 in the correct position. The spindles 5, 7 then rotate simultaneously in the same direction rotating the cage through the calculated angle. A second longitudinal bar 37 is then delivered by the bar feeder 3. The position of the bar 37 is adjusted, if required, and then it is welded to each of the rings 39. The operator repeats the process until all of the bars 37 have been welded to the rings 39 and a skeleton cage has been formed. For example, a skeleton cage may comprise eight longitudinal bars 37 uniformly spaced around the rings 39 at 45 degree intervals.

The operator then retracts the bar feeders 3 in preparation for the helixing operation.

The operator inputs values into the microprocessor control system via the user interface corresponding to the wrap pitch and the spindle speed required to form the cage. The helixing trolley 10 is moved along the apparatus to a position adjacent one end of the skeleton cage. The position of the guide rollers 87 is adjusted to leave a gap between the skeleton cage and the rollers 87 of approximately the diameter of the reinforcing bar +10 mm. One end of the reinforcing bar 77 is fed between the guide rollers 87 and is welded to the end of the skeleton cage. The wrapping process is initiated by the operator. This causes the spindles 5, 7 to rotate at the required spindle speed and the helixing trolley 10 to move simultaneously along the trolley guide 13 at the appropriate speed to produce the desired helixing pitch. As the cage rotates, reinforcing bar 77 is pulled from the helixing trolley 10 and is wrapped around the cage.

When the helixing trolley 10 reaches the end of the cage, its movement is halted, either by a limit switch or manually by the operator. The reinforcing bar 77 is cut and welded to a ring 39 or a longitudinal bar 37 to complete the cage.

At the end of a cage making operation, the moveable spindle 7 is disengaged from the cage by retracting the ring support members 49, is unclamped from the base 1 and displaced along the base 1 approximately 4.5 m away from the cage. This allows the cage to be removed from the apparatus transversely, that is, in a direction perpendicular to the machine axis. In some prior art machines completed cages are removed from the apparatus along the machine axis. Such machines require additional supports aligned with the axis to take the weight of the cage which produces an unnecessarily long machine. The arrangement of the present invention allows completed cages to be removed more easily from the side, and a more compact apparatus.

It will be appreciated that alterations can be made to the embodiment described above without departing from the spirit of the present invention. For example, a hopper can be fitted to the bar feeder 3 to controllably supply the bar feeder 3 with longitudinal bars 37, the spindles 5, 7 could grip the rings 39 externally, or the spindles 5, 7 may be arranged to rotate freely without a drive system linked thereto and an alternative drive system can be used to rotate the cage. The fixed spindle 5 may be replaced by a movable spindle 7.

I claim:

1. An apparatus for making a cage having a plurality of peripheral and elongate components, and a wrapping component, said apparatus including:

an elongate support frame having a longitudinal axis;

means for rotating the cage;

means for dispensing the wrapping component onto the cage;

a first carrier means mounted on the frame for holding at least one peripheral component;

a second carrier means mounted on the frame for holding at least one peripheral component including means for adjusting the position of the second carrier means on the frame relative to the position of the first carrier means; and a gripping device for engaging one or more of the peripheral components, wherein the gripping device is mounted for rotation in one of the first and the second carrier means, and includes an array of support members arranged substantially parallel to the longitudinal axis of the support frame so that the support members are extendable to engage one or more of the peripheral components and are retractable to disengage one or more of the peripheral components, and an actuator arranged for extending and retracting the array of support members substantially simultaneously.

2. An apparatus according to claim 1, wherein the means for adjusting the position of the second carrier means includes a carriage that is arranged for movement along at least part of the support frame.

3. An apparatus according to claim 1, wherein the means for rotating the cage is arranged to rotate the gripping device.

4. An apparatus according to claim 1, including a second gripping device mounted in the other of the first and the second carrier means.

5. An apparatus according to claim 4, wherein the means for rotating the cage is arranged to rotate the second gripping device.

6. An apparatus according to claim 1, wherein the gripping device is arranged to grip an internal face of the peripheral component.

7. An apparatus according to claim 1, including a feeder mechanism for feeding an elongate component such that the elongate component is positioned in contact with the peripheral components.

8. An apparatus according to claim 7, wherein the peripheral components have outer walls and the feeder mechanism is constructed and arranged to position the elongate component against the outer walls such that the peripheral components are substantially perpendicular to the elongate component.

9. An apparatus according to claim 7, wherein the feeder mechanism is positioned between the first and the second carrier means.

10. An apparatus according to claim 7, wherein the feeder mechanism includes an arm mounted for rotational movement.

11. An apparatus according to claim 7, wherein the feeder mechanism includes a telescopic arm.

12. An apparatus according to claim 1, including at least one support device arranged to support at least a part of the weight of the cage.

13. An apparatus according to claim 12, wherein the support device is mounted on the elongate support frame and includes means for moving its position along the elongate support frame.

14. An apparatus according to claim 12, wherein the height of the support device is adjustable.

15. An apparatus according to claim 1, wherein the means for dispensing the wrapping component onto the cage includes a mobile carriage arranged to follow a first guide device mounted on the elongate support frame.

16. An apparatus according to claim 15, wherein the mobile carriage includes a second guide device for guiding the wrapping component as it is dispensed onto the cage.

17. An apparatus according to claim 1, including a control unit for controlling operation of the apparatus, wherein the control unit includes a user interface that can be used by an operator and is arranged for inputting values corresponding to at least one of the diameter of the cage, a rotational speed of the cage, the number of elongate components and a wrap pitch required.

18. An apparatus according to claim 1, wherein the first carrier means includes means for adjusting its position on the frame relative to the position of the second carrier means.

19. An apparatus according to claim 1, wherein the peripheral component is a ring.

20. An apparatus according to claim 19, wherein the ring has a circular, polygonal or other peripheral shape.

21. An apparatus according to claim 1, wherein the wrapping component is a wire.

22. An apparatus according to claim 1, wherein the actuator comprises a control member, and the radial positions of the support members are controlled by a position of the control member.

23. An apparatus according to claim 22, wherein the control member is arranged for movement in a direction substantially parallel to the longitudinal axis of the support frame such that movement away form the cage causes the array of support members to deploy, and movement in the opposite direction causes the array of support members to retract.

24. Apparatus according to claim 22, wherein the support members are pivotally mounted on a rotatable shaft having a longitudinal axis and the control member is arranged for linear movement in a direction parallel to the longitudinal axis of the shaft, and the radial position of the support members is determined by the position of the control member relative to the shaft.

25. Apparatus according to claim 24, wherein the shaft is tubular and the control member comprises a rod arranged for sliding movement therein.

26. Apparatus according to claim 24, wherein each support member is pivotally attached to the shaft by a pair of linkages, and one linkage of each pair of linkages is connected to the control member by a drive member.

27. An apparatus for making a cage having a plurality of peripheral and elongate components and a wrapping component, said apparatus including:

an elongate support frame having a longitudinal axis;

means for rotating the cage;

means for dispensing the wrapping component onto the cage;

a first carrier means mounted on the frame for holding at least one peripheral component;

a second carrier means mounted on the frame for holding at least one peripheral component, including means for adjusting the position of the second carrier means on the frame relative to the position of the first carrier means;

a gripping device rotatably mounted in at least one of the first and second carrier means, including a rotatable shaft, an array of support members that are pivotally attached to the shaft, and a control member arranged to move linearly relative to the shaft, wherein the support members are arranged to be deployed substantially simultaneously to engage one or more of the peripheral components and retracted substantially simultaneously to disengage one or more of the peripheral components, and the extent of deployment of the support members is determined by the position of the control member relative to the shaft.

28. Apparatus according to claim 27, wherein movement of the control member away from the cage causes the array of support members to move radially outward and movement of the control member in the opposite direction causes the array of support members to move radially inward.

29. Apparatus according to claim 27, wherein the shaft is tubular and the control member comprises a rod arranged for sliding movement therein.

30. Apparatus according to claim 27, wherein the support members are elongate, and are arranged substantially parallel to the longitudinal axis of the support frame.

31. Apparatus according to claim 27, wherein each support member is pivotally attached to the shaft by a pair of linkages and one linkage of each pair of linkages is connected to the control member by a drive member.

* * * * *